United States Patent [19]

Tanaka et al.

[11] Patent Number: 5,018,366

[45] Date of Patent: May 28, 1991

[54] CONTROL CIRCUIT UNIT FOR A VARIABLE CAPACITY COMPRESSOR INCORPORATING A SOLENOID-OPERATED CAPACITY CONTROL VALVE

[75] Inventors: Hiroshi Tanaka; Chuichi Kawamura; Junichi Ohno, all of Kariya, Japan

[73] Assignee: Kabushiki Kaisha Toyoda Jidoshokki Seisakusho, Aichi, Japan

[21] Appl. No.: 306,342

[22] Filed: Feb. 3, 1989

[30] Foreign Application Priority Data

Feb. 5, 1988 [JP] Japan ..... 63-26375

[51] Int. Cl.[5] ..... F25B 1/00

[52] U.S. Cl. ..... 62/228.5; 307/254; 361/154

[58] Field of Search ..... 361/154; 251/129.01; 417/222, 270; 62/228.5; 307/254, 270

[56] References Cited

U.S. PATENT DOCUMENTS 3,577,040 5/1971 Campbell, Jr. ..... 361/154
3,614,543 10/1971 Dick ..... 361/154
4,310,868 1/1982 Lille et al. ..... 361/154
4,586,874 5/1986 Hiraga et al. ..... 417/222
4,747,754 5/1988 Fujii et al. ..... 417/222

OTHER PUBLICATIONS

Basic Electronics; Bureau of Naval Personnel, 6/1955 pp. 58–60.

*Primary Examiner*—William E. Wayner
*Attorney, Agent, or Firm*—Burgess, Ryan & Wayne

[57] ABSTRACT

A control circuit unit for controlling the energization of a solenoid of a solenoid-operated capacity control unit incorporated in a a variable capacity compressor, typically, a variable capacity wobble plate type refrigerant compressor for a car air-conditioner, having a switching unit for establishing an electric conduction of the energizing circuit of the solenoid when the solenoid-operated valve is actuated for changing the compressor capacity, and an electric energizing voltage control circuit used to apply a high electric starting voltage to the solenoid emergizing circuit at a predetermined initial starting time of the solenoid, and a low electric retaining voltage required for retention of the energization of the solenoid valve after the predetermined starting time has elapsed.

5 Claims, 3 Drawing Sheets

CONTROL CIRCUIT UNIT FOR A VARIABLE CAPACITY COMPRESSOR INCORPORATING A SOLENOID-OPERATED CAPACITY CONTROL VALVE

BACKGROUND OF THE INVENTION

1. Field of the Invention

The present invention relates generally to an electric drive unit for a solenoid-operated control valve of a variable displacement compressor. More particularly, it relates to an electric control circuit unit for controlling the energization of a solenoid element of a solenoid-operated capacity control unit of a variable capacity refrigerant compressor for use in a car air-conditioning system.

2. Description of the Related Art

A variable displacement wobble plate type compressor is known as a typical variable capacity compressor adapted for incorporation in a car air-conditioning circuit to compress a refrigerant gas. U.S. Pat. No. 4,747,754 to Fujii et al discloses a variable capacity wobble plate type compressor with a solenoid-operated wobble angle control unit, in which a solenoid valve is used for closing and opening a fluid passageway between a crankcase chamber provided for accommodating a drive and a wobble plate assembly operatively connected to a piston mechanism compressing the refrigerant gas and a discharge chamber for receiving therein a compressed refrigerant gas. The communication between the crankcase and the discharge chamber through the fluid passageway opened by the solenoid valve increases a pressure level in the crankcase chamber, and an interruption between both chambers due to closing of the fluid passageway by the solenoid valve decreases a pressure level in the crankcase. The increase and decrease of the pressure level in the crankcase chamber causes a change in an angularity of the drive and wobble plate assembly with respect to a small angularity erect position, thus causing a change in a reciprocating stroke of the piston mechanism which, in turn, causes a change in a compressing capacity of the compressor. Therefore, the combination of the solenoid valve, the fluid passageway, and the drive and wobble plate assembly is considered to be a solenoid-operated capacity control unit of the variable capacity type wobble plate type compressor.

U.S. Pat. No. 4,586,874 to Hiraga et al, discloses another type of capacity control system for a variable displacement wobble plate type compressor, in which the solenoid-operated valve is arranged so as to be capable of opening and closing a fluid passageway between a crankcase chamber and a suction chamber of the compressor. That is, when the fluid passageway is opened by the solenoid valve unit, a decrease in pressure within the crankcase chamber occurs so that the angularity of the wobble plate can be increased. An increase in pressure in the crankcase chamber is caused by a high pressure blow-by gas leaking from the cylinder bores, to permit the compressor pistons to reciprocate to compress the refrigerant gas.

In the above-mentioned typical conventional variable capacity compressors, when the solenoid valve is electrically energized by the supply of an electric start voltage, to thereby open or close the fluid passageway, the opened or closed condition of the fluid passageway is usually maintained for a certain period of time, i.e., the energization of the solenoid of the solenoid valve must be retained by the supply of the same electric voltage as the initial electric start voltage supplied thereto during that period. More specifically, the conventional design of the solenoid-operated capacity control valve is based on the principle that, after the switching of the solenoid-operated valve is completed, the high starting voltage required to start the switching motion of the valve is continuously maintained to energize the solenoid of the solenoid-operated valve until de-energization of the solenoid is required. Note, the electric starting voltage must be appreciably higher than that required for retention of the energization of the solenoid, and therefore, the heat generated by the solenoid is very high, and thus the temperature of the solenoid becomes very high. In the case of the variable capacity refrigerant compressor used in a car compartment air-conditioning system, the compressor is driven by the car engine via a rotation transmitting system, and a solenoid clutch device is mounted in the engine compartment where the temperature is very high during the operation of the engine, and therefore, the temperature of the solenoid per se may reach 200° C. or higher due to the heat generated by the high energizing voltage and the temperature of the engine compartment. This high temperature causes problems such as a reduction in an electromagnetic force of the solenoid due to an increase in the electric resistance of the solenoid affected by the high temperature, and a reduction in the strength of the plastic materials used for the molding and insulating of the wiring of the solenoid. Further, the car battery must supply the high electric power for maintaining the energization of the solenoid of the solenoid-operated capacity control unit of the compressor, in addition to the electrical power supply required for actuating the above-mentioned solenoid clutch to couple the compressor to the car engine.

SUMMARY OF THE INVENTION

Therefore, an object of the invention is to provide a control circuit unit for the solenoid-operated valve employed in the capacity control system of the variable capacity compressor which, when energized to change the compressor capacity, enables the heat generation and the electrical power consumption of the solenoid to be reduced.

Another object of the present invention is to provide an electric control circuit unit capable of ensuring a long life of the solenoid-operated capacity control unit of a variable capacity refrigerant compressor for a car air-conditioner, to thereby prolong the life of the compressor per se.

A further object of the present invention is to provide a simple electric control circuit unit for controlling the operation of a solenoid-operated capacity control unit for a variable capacity compressor.

Therefore, in accordance with the present invention, there is provided a control circuit unit for controlling the operation of a solenoid-operated capacity control unit of a variable capacity refrigerant compressor accommodated in a car air-conditioning system and provided with a compressor framework having therein a suction chamber for a refrigerant to be compressed and a discharge chamber for a compressed refrigerant to be discharged to the car air-conditioning circuit, a rotatable drive shaft connectable to a rotation drive source, a variable capacity compressing unit for sucking, compressing and discharging the refrigerant in response to the rotation of the drive shaft, and capacity control refrigerant passageways for controlling a pressure acting on the variable capacity compressing unit, the capacity control refrigerant passageways being opened and closed by the operation of a valve element of the solenoid-operated capacity control unit. The control circuit unit comprises:

an electric switching circuit portion for controlling an electric energizing circuit of a solenoid of the solenoid-operated capacity control unit; and, an electric energizing voltage control circuit portion for controlling a level of an electric voltage applied to the solenoid when energized by the electric switching circuit portion, in such a manner that a high level electric starting voltage used to initiate a movement of the valve element of the solenoid-operated capacity control unit is applied to the solenoid for a predetermined time, and that after the predetermined time has elapsed, a low level electric retaining voltage is supplied to maintain the solenoid of the solenoid-operated valve in an energized condition.

The electric energizing voltage control circuit portion of the control circuit unit preferably comprises a time delay circuit able to change the electric voltage applied to the solenoid from the high level electric starting voltage to the low level electric retaining voltage after the predetermined time has elapsed.

BRIEF DESCRIPTION OF THE DRAWINGS

Other objects, features and advantages of the present invention will be made more apparent from the description of the embodiment of the present invention with reference to the accompanying drawings, wherein.

DESCRIPTION OF THE PREFERRED EMBODIMENTS

The following description is provided for the case wherein the present invention is embodied by a variable capacity wobble plate type compressor with a solenoid-operated wobble angle control unit, used in an air conditioning system for a car compartment, Note, U.S. Pat. No. 4,747,754 is incorporated only for reference since the internal mechanical construction and components of this invention are similar to those of the compressor disclosed in the U.S. Pat.

Figure 1:
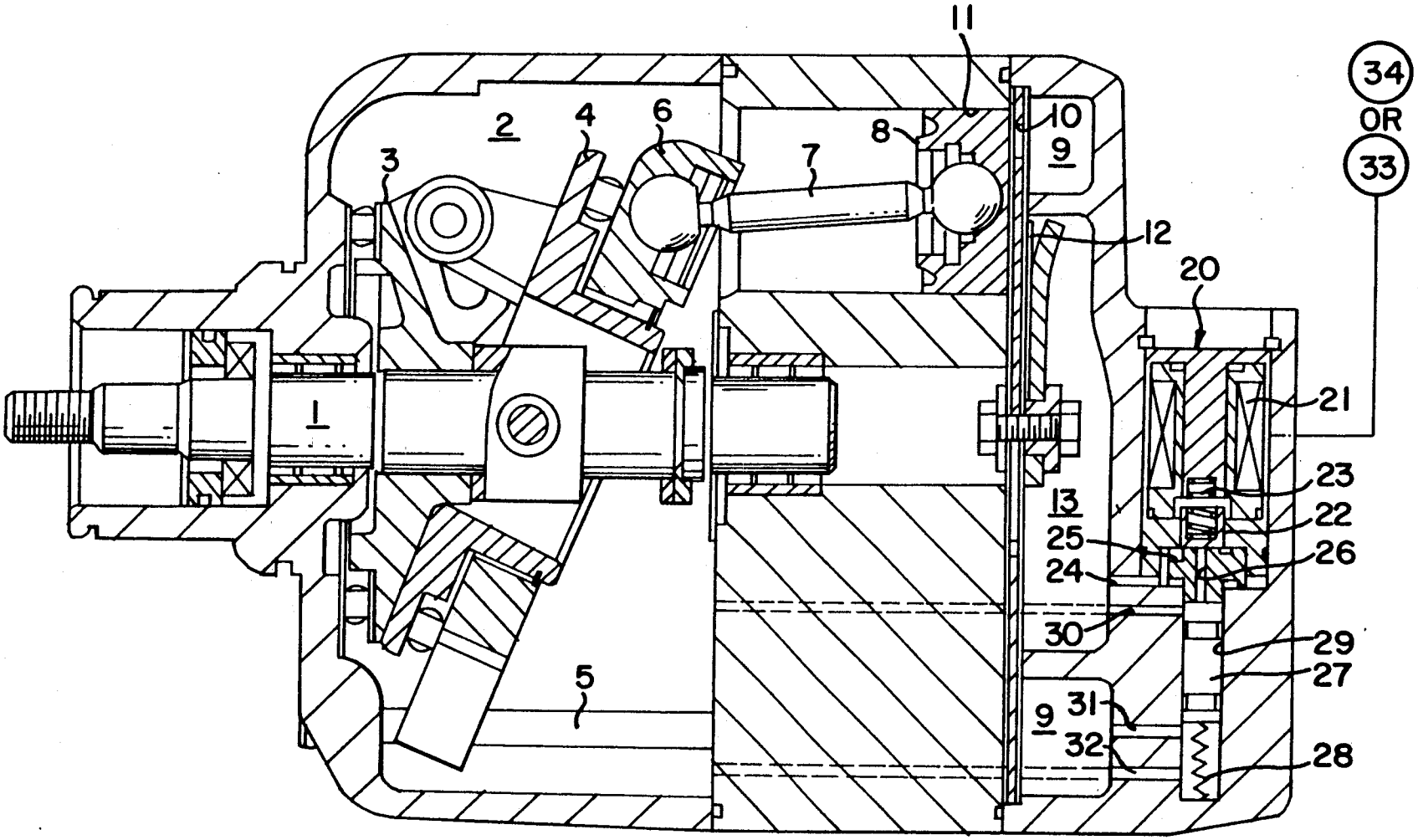
FIG. 1 is a vertical cross sectional view of a variable displacement wobble plate type compressor employing a solenoid-operated valve capacity control system.

Referring to FIG. 1, illustrating a variable capacity wobble plate type compressor, the compressor is centrally provided with an axial drive shaft 1 having an outer end connectable to and driven by a car engine through an appropriate coupling means, such as a solenoid clutch (not shown). A rotary support plate 3 and a rotary driving plate 4 are located in a crank case and mounted on the drive shaft 1 to rotate together therewith. A non-rotable wobble plate 6 causing later-described reciprocation of pistons 11 is slidably supported by a rotary drive plate 4 and fixed against rotation by an axially longitudinal guide bar 5 which can be one of long screw bolts used to axially fasten a crankcase and a cylinder block together. A plurality of pistons 8 are fitted in respective cylinder bores 11 of the cylinder block and connected to the wobble plate 6 via connecting rods 7, to thereby reciprocatorily slide in the axial direction in response to the rotation of the drive shaft 11.

When the drive shaft 1 is driven by a car engine, the rotary support plate 3 and the rotary drive plate 4 are rotated together with the drive shaft 1. This rotary motion of the rotary drive plate 4 causes a wobbling motion of the wobble plate 6, because the rotary drive plate 4 rotates within a plane forming an oblique angle with the shaft 1 and the wobble plate 6 is fixed against rotation by the guide bar 5. The pistons 8 are driven by the wobble plate 6 via the connecting rods 7, and move reciprocatively within the cylinder bore 11. Due to the reciprocating movements of the pistons 8, refrigerant gas is admitted to cylinder bores 11 from a suction chamber 9 via suction valves 10, and after compression in the cylinder bores 11, the compressed refrigerant gas is discharged from the cylinder bores 11 to a discharge chamber 13 via discharge valves 12. The compressed refrigerant gas is then delivered to a car air-conditioning circuit from the discharge chamber 13 of the compressor.

When a pressure level in the interior chamber 2 of the crankcase is increased and becomes higher than the pressure prevailing in the suction chamber 9, the angularity of the wobble plate 6 decreases to set the wobble plate 6 in an erect position near to a plane perpendicular to the axis of the shaft 1, because a high pressure in the chamber 2 of the crankcase is exerted on the back face of the respective pistons 8. The stroke of the pistons decreases due to decrease in the angularity of the wobble plate 6, and consequently, the displacement and the capacity of the compressor are decreased.

Conversely, when a pressure level in the crankcase chamber 2 is decreased, the angularity of the wobble plate 6 is increased from the erect position, and accordingly, the stroke of the pistons 11 and the capacity of the compressor are increased.

The above mentioned capacity control, i.e., the control of the pressure level in the crankcase chamber 2, is performed by a solenoid-operated valve 20 incorporated in a rear housing of the compressor illustrated on the right hand side of FIG. 1.

When a solenoid 21 of the solenoid-operated valve 20 is electrically energized by the supply of electric energy, from the car battery the solenoid 21 is magnetized to pull a plunger 22 upward against the force of a biasing spring 23. Then, the pressure gas in the discharge chamber 13 is brought to the upper face of a spool valve 27 through fluid passageways 24 and 25 and a valve port 26 to apply a downward pressure to the upper face of the spool valve 27. The spool valve 27 is therefore moved downward against a lower spring 28. This allows the refrigerant gas in the discharge chamber 13 to flow into the crankcase chamber 2 via a spool port 29 and a fluid passageway 30. At the same time, the communication between the fluid passageway 31 and 32 is interrupted by the spool valve 27, and the pressure in the crankcase chamber 2 is increased.

On the other hand, when the solenoid 21 is de-energized, the plunger 22 is moved downward by the force of the biasing spring 23 and cuts off the communication between the discharge chamber 13 and the crankcase chamber 2 by closing the fluid passageways 25, 26. Simultaneously, the spool valve 27 is urged to move upward by the spring 28, and this allows the passageways 31 and 32 to be opened, and thus the communication between the crankcase chamber 2 and the suction chamber 9 is established by the passageways 31 and 32. This causes the refrigerant gas in the crankcase chamber 2 to be drawn into the suction chamber 9, to decrease the pressure level in the crankcase chamber 2.

Figure 2:
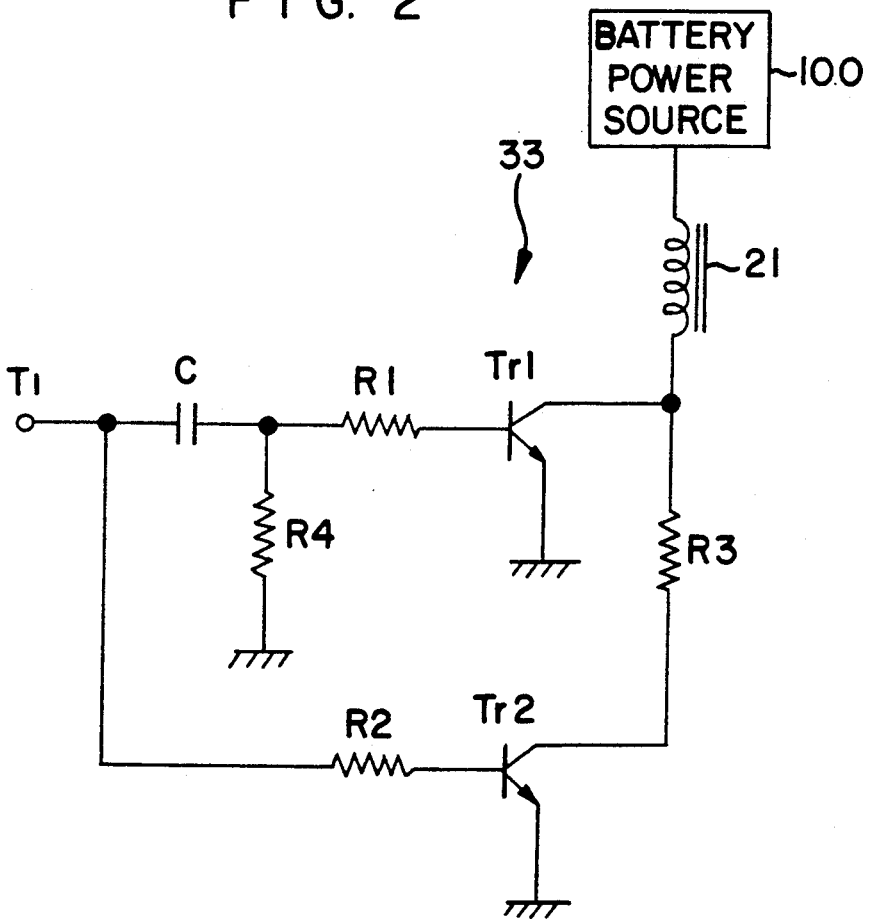
FIG. 2 is a schematic circuit diagram illustrating the electrical circuit of the control circuit unit according to an embodiment of the present invention, used for controlling the solenoid-operated valve of the compressor of FIG. 1.

Referring now to FIG. 2, illustrating a control circuit unit 33 incorporated in a controller (not shown) for actuating the above-described solenoid-operated valve 20 described above, the control circuit unit 33 has an input terminal T1 to which a signal commanding energization of the solenoid-operated valve 20 is input. Connected to the input terminal T1 is a time constant circuit including an electric capacitor C and an electric resistance R4, which circuit is also connected to the base of a switching transistor Tr1 via an electric resistance R1 for determining the magnitude of an electric current flowing through the transistor Tr1. The base of another transistor Tr2 for switching is also connected to the input terminal T1 via an electric resistance R2 for setting the magnitude of the current flowing through the transistor Tr2. The collector of the transistor Tr1 is connected to the solenoid 21 directly, and the collector of the transistor Tr2 is connected to the solenoid 21 via an appropriate electric resistance R3 arranged in series with the solenoid 21 of the solenoid-operated valve 20. The other terminal of solenoid 21 is connected to the car battery 100.

The description of the operation of the control circuit unit 33 is as follows.

When a capacity of the compressor is to be reduced in response to, e.g., the lowering of a cooling load and capacity of the compressor, and the accelerating operation of the car, a DC voltage is applied to the input terminal T1. As soon as the DC voltage is applied to the terminal, the charging of the capacitor C starts, and the voltage across the capacitor C starts to increase. During the charging of the capacitor C, a part of the input terminal voltage is applied to the base of the transistor Tr1, which allows the transistor Tr1 to switch ON and form a series energizing circuit comprising the solenoid 21 and the transistor Tr1. Also, another part of the input terminal voltage is applied to the transister Tr2, to swich ON the transister Tr2, and thus a high starting voltage is applied through both transisters Tr1 and Tr2 to the solenoid 21. This starting voltage allows the solenoid-operated valve 20 to be actuated; namely, an initial axial movement of the plunger 22 is caused, and as a result, the compressor capacity is reduced as described before.

Then, after a given time determined by the parameters of the capacitor C and the resistance R4, the capacitor C is electrically charged to a certain level, and the DC voltage applied to the base of the transistor Tr1 is reduced to switch off the transistor Tr1. This cuts off the energizing circuit formed by the solenoid 21 and transistor Tr1. Nevertheless, another energizing circuit formed by the solenoid 21, the resistance R3, and the transistor Tr2 maintained at the ON condition is still alive. Therefore, the energization of the solenoid 21 is retained by an electric retaining voltage which is lower than the above-mentioned starting voltage. Therefore, as will be understood from the graph of FIG. 3, the initial energization of the solenoid-operated valve 20 by the high electric starting voltage lasts for a predetermined time to thereby bring the fluid passages 25, 25, 30, 31, and 32 of the compressor to a low compressor capacity position. Thereafter, when the predetermined time has passed, the energization voltage applied to the solenoid 21 of the solenoid-operated valve 20 is switched from the higher starting voltage to the lower retaining voltage sufficient to retain the low capacity valve position.

Figure 3:
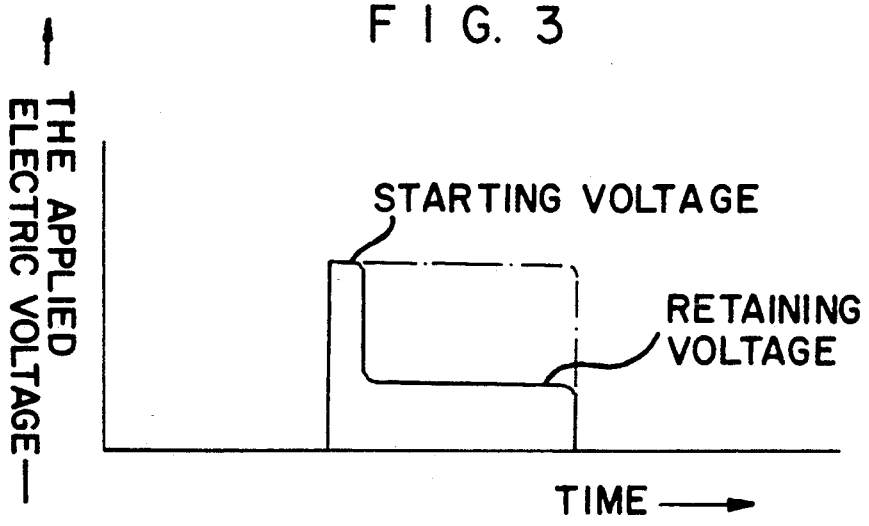
FIG. 3 is a graph illustrating a time dependent characteristic of the voltage applied to the solenoid by the control circuit unit of FIG. 2, in which the ordinate represents the applied electric voltage and the abscissa represents time.

Different from the control means in the prior art in which, as indicated by a chain line in FIG. 3, a higher starting voltage is maintained after the completion of the initial movement of the solenoid-operated valve, the control circuit unit according to the invention has the advantage of positively reducing the heat generation in the solenoid 21, and thus enables an avoidance of a reduction in electromagnetic force due to an increase in the electric resistance of the solenoid coil caused by a high temperature, and a reduction in the strength of the plastic material used in the molding insulation of the wiring of the solenoid coil. Furthermore, according to the present invention, it is possible to reduce the electric power consumption of the solenoid-operated valve 20, and thus the electric load applied to a car battery during the operation of the compressor can be reduced.

Figure 4:
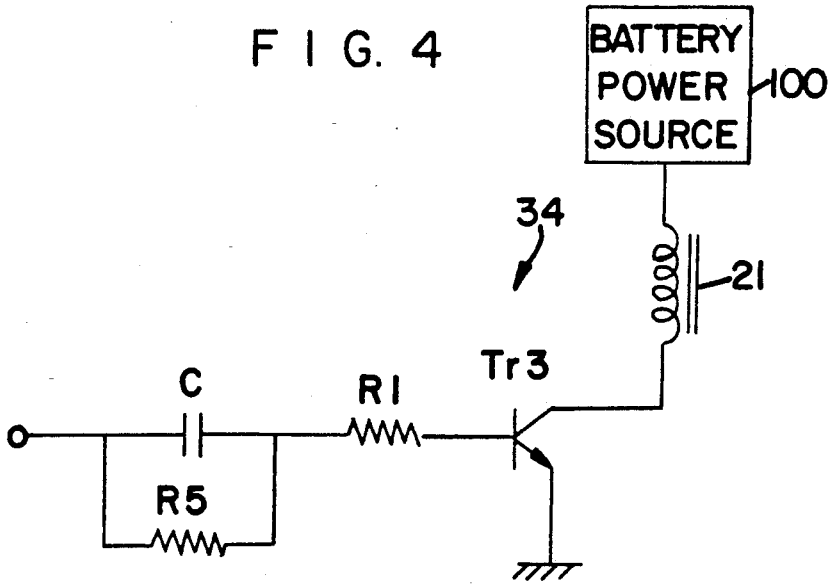
FIG. 4 is a schematic diagram of the control circuit unit according to another embodiment of the present invention.

Referring now to FIG. 4, which illustrates a control circuit unit 34 according to another embodiment of the present invention, in this embodiment, only one transistor Tr3 is employed for amplification only, and an electric resistance R5 is connected in parallel with a capacitor C. Therefore, in this embodiment, until the capacitor C is electrically charged to a predetermined level, an electric high base voltage via the resistance R1 is applied to the transistor Tr3, with the result that a higher starting voltage is applied to the solenoid 21 of the solenoid-operated valve 20. After the capacitor C is charged to the predetermined level, an electric retaining voltage lower than the starting voltage is applied to the solenoid 21 via the resistances R1 and R5.

Although particular elements and application of the invention are indicated above, it will be understood that the present invention is not limited thereto, and the various modifications are possible within the scope of the invention, e.g., the invention can be applied to other types of compressors such as a vane type rotary compressor.

We claim:

1. A control circuit for controlling an operation of a solenoid-operated capacity control unit of a variable capacity refrigerant compressor accommodated in an air-conditioning system of an automobile and provided with a compressor framework having therein a suction chamber for a refrigerant to be compressed and a discharge chamber for a compressed refrigerant to be discharged to the air-conditioning system, a rotatable drive shaft connectable to a rotation drive source, a variable capacity compressing unit for sucking, compressing and discharging the refrigerant in response to the rotation of the drive shaft, and a capacity control refrigerant passageway means for controlling a pressure acting on the variable capacity compressing unit, said capacity control refrigerant passageway means being opened and closed by an operation of a valve element of the solenoid-operated capacity control unit, said control circuit comprising:

a single DC electric power source for supplying electric voltage to a solenoid of said solenoid-operated capacity control unit, said electric switching circuit means comprising two parallel transistor switching circuits arranged in an electric energizing circuit of said solenoid of said solenoid-operated capacity control unit for permitting an application of a high DC voltage to the electric circuit of the solenoid when both of the parallel transistor switching circuits are turned ON, and permitting an application of a low DC voltage to the electric energizing circuit of the solenoid when only one of the parallel transistor switching circuits is turned ON; and electric energizing voltage control circuit means for controlling the level of said electric voltage applied to said electric energizing circuit of said solenoid from said single electric power source in such a manner that a high level electric starting voltage needed to initiate a movement of the valve element of said solenoid-operated capacity control unit is applied to said electric energizing circuit of said solenoid for a predetermined time, through said two parallel transistor switching circuits, and that after said predetermined time has elapsed, a low level electric retaining voltage needed to retain said solenoid of said solenoid-operated capacity control unit at an energized position is applied through said only one of said two parallel transistor switching circuits.

2. A control circuit means according to claim 1, wherein said electric energizing voltage control circuit means comprises time delay circuit means for changing said electric voltage applied to said solenoid from said high level electric starting voltage to said low level electric retaining voltage after said predetermined time has elapsed.

3. A control circuit means according to claim 2, wherein said time delay circuit means comprises a time constant circuit including electric capacity element means for electrically determining said predetermined time and electric resistance element means for determining said low level electric retaining voltage applied to said solenoid.

4. A control circuit means as claimed in claim 1, wherein said two parallel transistor switching circuits of said electric switching circuit means comprises first and second transistor means for establishing an electric conduction of said electric energizing circuit of said solenoid of said solenoid-operated capacity control unit when said transistor means are turned ON, said first transistor means having a base thereof to which a gradually decreased electric switching voltage is supplied for said predetermined time to establish said high level starting voltage for said predetermined time, and said second transistor means having a base thereof to which a constant switching voltage is applied to establish said low level electric retaining voltage after said predetermined time has elapsed.

5. A control circuit means as claimed in claim 1, wherein said variable capacity refrigerant compressor comprises a variable capacity wobble plate type compressor incorporating said solenoid-operated capacity control unit in said framework including a crankcase and a cylinder block.

* * * * *